United States Patent [19]

Forst et al.

[11] 3,952,663

[45] Apr. 27, 1976

[54] DIFFUSER

[76] Inventors: John J. Forst, 14 Round Top Road, Warren, N.J. 07060; Kenneth L. Willison, 16 Woodland Ave., Hamburg, N.J. 07419

[22] Filed: June 21, 1974

[21] Appl. No.: 481,927

[52] U.S. Cl. ..... 102/73 R; 102/70 R
[51] Int. Cl.[2] ..... F42C 1/00
[58] Field of Search ..... 102/70 R, 73, 76, 81, 102/81.2

[56] References Cited

UNITED STATES PATENTS

| | | | |
|---|---|---|---|
| 1,666,792 | 4/1928 | Remondy | 102/73 R |
| 2,779,285 | 1/1957 | Kuller | 102/73 R |
| 3,135,206 | 6/1964 | Hjelm | 102/73 R |
| 3,726,228 | 4/1973 | Lohninger et al. | 102/73 R |
| 3,807,307 | 4/1974 | Putscher | 102/73 R |
| 3,854,402 | 12/1974 | Kosonocky | 102/73 R |

*Primary Examiner*—Samuel W. Engle
*Assistant Examiner*—Harold Tudor
*Attorney, Agent, or Firm*—Nathan Edelberg; Robert P. Gibson; Costa Perchem

[57] ABSTRACT

This invention deals with the problem of premature functioning of shells with point detonating fuzes. A diffuser is provided in a fuze head to prevent a direct impact on the detonator by providing an effective cover to all elements of the detonator. This is done by providing the fuze head with a twisted flat, rectangular plate, which is substantially rigid for protection against, solid objects, the build-up of a large volume of rain and inhibit direct impact of such material upon the detonator.

1 Claim, 4 Drawing Figures

DIFFUSER

GOVERNMENTAL INTEREST

The invention described herein may be manufactured, used and licensed by or for the Government for governmental purposes without the payment to us of any royalty thereon.

BACKGROUND OF THE INVENTION

This invention relates to fuzes and more particularly to a fuze for an explosive apparatus that is protected against premature detonation until it reaches the intended target. In heavy tropical-like rain storms the mass of raindrops coupled with their relative velocity with respect to a projectile in flight imparts a sufficient impulse on the point of detonating element to cause premature functioning. Premature functioning is also caused by umbrellas of dense foliage when penetrated by point detonating shells.

The prior structures related to the subject invention is described in U.S. Pat. No. 3,726,228 filed Nov. 23, 1970, issued Apr. 10, 1973 and application Ser. No. 468,723 filed May 10, 1974. More specifically, the Density Integrating Fuze Head described in the reference patent provided cross-bars as a protective shield to prevent premature detonation. In the reference application is shown a twisted cruciform as a protective shield to prevent premature detonation. The cross-bars and the twisted cruciform were used in the fuze head as a mechanical barrier which allowed retaining the sensitivity of the fuze while still exposing the shell to various interferences before impact with the ground. These barrier devices including the relief vents have been particularly well adapted in actual use associated with military fuzes in a tropical environment.

The prior structures, however, have several drawbacks as for example the referenced patent shows various objects are able to by-pass the cross-bars and impact directly on the detonator causing the shell to prematurely explode. The cross-bars cover less than 20% of the surface of the detonator permitting the detonator to be exposed to direct impact. Furthermore, the cross-bars are capable of accumulating water from raindrops and when the volume could not be retained, the water would move directly upon the detonator with a greater mass causing the shell to explode. In addition, under the action of an impact force produced by leaves, limbs and thin branches, a cross-bar is subject to bending and probable dislocation. In fact, the resistance or stiffness of a cross-bar to bending is substantially less than the resistance of a solid protective piece resting at the base since it is susceptible only to compression. When under the action of an impact force a cross-bar is bent towards the closing disc to a deflection equal to its diameter, then the cross-bar slips out from the cross-bar holder and offers no resistance against subsequent impact.

The referenced application uses a twisted cruciform that is inserted and fixed in the cavity similar to the subject invention. However, the cost of manufacture and assembly is considered to be greater than desirable. In addition, the subject invention is an improved diffuser which eliminates the manufacturing problems inherent in the cross-bars and the twisted cruciform design and can be produced at substantially less cost.

Accordingly, the instant invention pertains to a diffuser that sets up a barrier with which the large raindrops collide with the barrier and are broken up into small droplets or atomized and deflected away from the detonating element. In the case of foliage, the diffuser sets up a barrier restraining the foliage from contacting the detonating element and thereby preventing the premature functioning of the shell.

BRIEF SUMMARY OF THE INVENTION

The present invention utilizes a similar theory as the above-mentioned references to accomplish the protection of the detonator. The particular embodiment of the barrier disclosed in this application provides complete protection for the detonator dispersing and deflecting the incoming material thereby preventing a direct impact upon the detonator.

It is, therefore, an object of the present invention to provide a baffle that effectively covers the surface of the detonator while the detonator retains its sensitivity.

It is a further object to provide a method to prevent direct impact upon the detonator until the shell has reached its target.

Another object is to provide a diffuser which is easily produced and assembled eliminating the manufacturing problems inherent in prior designs, but also to produce the item at less cost.

There are other objects of the present invention which will become apparent from the following description, taken in conjunction with the accompanying drawings, in which:

DETAILED DESCRIPTION OF A PREFERRED EMBODIMENT

Figure 2:
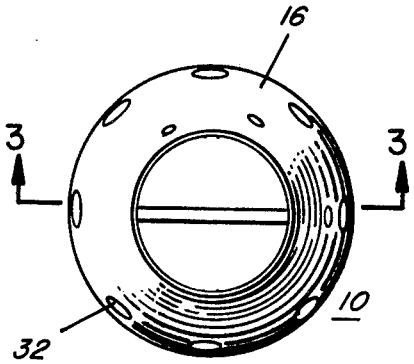
FIG. 2 is the top view of the fuze head.
Figure 3:
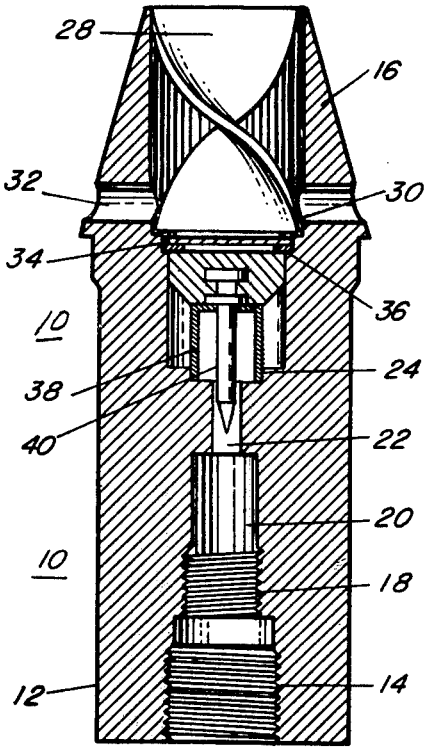
FIG. 3 is a longitudinal section view of the fuze head with the diffuser in place taken on line 3—3 of FIG. 2.
Figure 4:
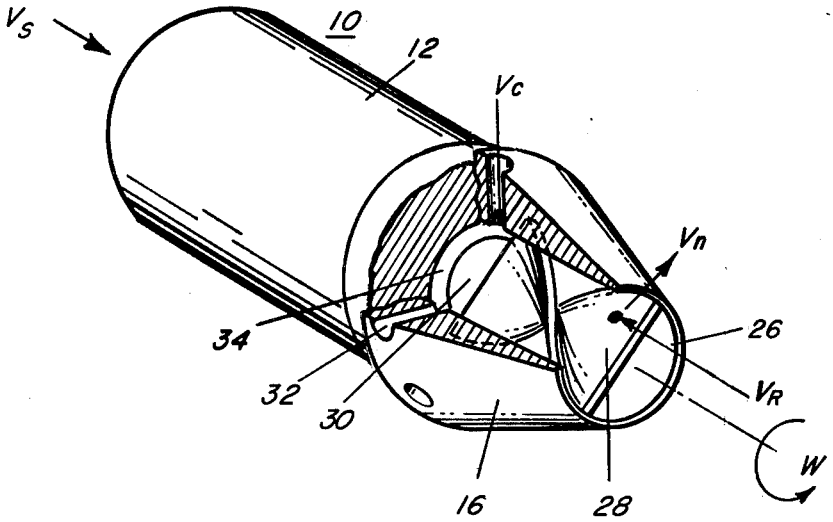
FIG. 4 is an isometric view partly in section showing further details of construction.

Referring to FIGS. 2, 3 and 4, fuze head 10 is formed of a hollow cylindrical base portion 12 capped by a truncated conically shaped nose end 16. The base portion 12 is drilled and tapped at one end 14 so that it may be secured in a fuze. The cylindrical base portion 12 and the mechanism contained therein, which are conventional although not an object of this invention, will be discussed and numerically referenced for purposes of clarity.

Figure 1:
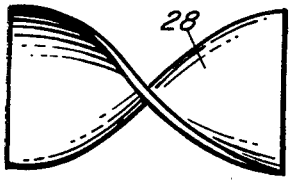
FIG. 1 is an isometric view of the diffuser.

The fuze head 10 has an irregularly shaped passageway formed therein by a series of bores which extend from the threaded end of the fuze head 10 through the truncated conical nose end portion 16. The passageway is composed of a series of axially communicating bores to provide a continuous central passageway of varying diameter through the fuze head 10: a threaded bore 14, reduced central threaded bore 18, cylindrical bore 20, a reduced cylindrical bore 22, an enlarged cylindrical bore 24 and a further enlarged cylindrical bore 26 in the conical nose end portion 16 of the fuze head 10. The interior of the enlarged cylindrical bore 26 is open to the atmosphere at the nose end of the fuze. Within the enlarged cylindrical bore 26 is mounted the diffuser 28 shown in FIG. 1 in isometric form. The diffuser 28 is a rectangular plate of metal, or other suitable material which is provided with an augertype twist of at least 100° and preferably not more than 180° from the forward end to the rear end of said plate. The plate should be sufficiently strong and rigid to withstand the impact of rain and foliage and other material encountered during trajectory. The length of the diffuser 28 should be no greater than the length of the enlarged cylindrical bore 26 in the fuze head. The diffuser 28 is mounted as a press fit into cylindrical bore 26 of the fuze head having end support 30. The diffuser 28 cannot rotate but is stationary in this position. Viewed from the front end, diffuser 28 provides a continuous protective wall from the front to the rear of said diffuser against material entering the cylindrical frame. With this geometry, no raindrop can achieve a direct impact on the closing disc, but will strike the diffuser, break up into small droplets and be deflected to the radial apertures 32. The device is provided with suitable radial apertures 32 communicating with the enlarged cylindrical bore 26 to permit the escape of water and prevent the build-up of air pockets within the cylindrical bore 26. The closing disc 34 and washer 36 are secured at the bottom portion of the cylindrical bore 26 and positioned below the apertures 32. A crush cup 38 is positioned in the bore 24 contiguous with the closing disc 34 and the washer 36. The detonator pin 40 which is appropriately housed in the casing, positioned in the cylindrical bore 24 is mounted on, and partially penetrates the crush cup 38. The detonator pin 40 is a weighted cylindrical body having a double flange formed at one end which is axially positioned on the crush cup 38.

FIG. 4 is an isometric view partly in section showing the fuze head as it appears in flight and presents the generalized theory of a functioning diffuser. Velocity direction of the shell is represented by Vs and Vr, the velocity direction of a raindrop with respect to the diffuser 28. W represents a counterclockwise rotation of the shell viewing it from upstream. Under these conditions of shell motion, the diffuser 28 would have a counter-clockwise twist so that the direction Vn of the dispersed raindrops would tend to be normal to the diffuser surface at the points of collision and thus directed away from the detonating elements. Vc is the velocity direction through the apertures 32 of an accumulation of water reaching the surface at the rear of the diffuser 28. For shells with clockwise rotation as viewed upstream the diffuser 28 would have a clockwise twist. The amount of diffuser 28 twist depends on a predetermined maximum shell velocity, the shell's angular rate of rotation and diffuser length. The amount of twist would be such that for a given flight condition, the diffuser 28 would set up a barrier at any point along its length.

In operation, a conventional fuze of the impact variety would detonate when hitting or striking an obstacle during its trajectory. Obstacles such as leaves, foliage or rain would generate sufficient force to rupture the closing disc 34, collapse the crush cup 38 and force the bottom portion of the detonator pin 40 through bore 22 into bore 20 thereby initiating the round. This type of conventional round cannot penetrate a canopy of foliage, pass through a rainstorm or overcome the resistance of sand storms and reach its intended target without premature detonation. In addition, greater efficiency and capability are required, since fuzes are made more sensitive, and projectiles and missiles are urged to higher velocities. To accomplish this goal, it was required that a higher order was needed to solve this problem.

It has now been discovered that in order to secure the most effective results from such projectiles and missiles, especially when they are used in the tropics and directed toward densely wooded areas or during rain and sand storms, is to effectively cover the detonator completely. Accordingly, the embodiment of the diffuser 28 was conceived as previously described herein which improves the penetrability of the shell and at the same time retains its sensitivity to impact with large objects. This is accomplished with a geometry characterized by the twisted rectangular plate where incoming material cannot achieve a direct impact on the closing disc but will hit the walls of said twisted plate. In many cases this material breaks up into small fragments which reduces their mass and their subsequent impact force on the detonator. The diffuser 28 and the radial vent holes 32 considered together act essentially as a projectile borne one way valve with a selective or differentiating response to water, air and other solid materials. Using this method, it is possible to provide a greater number of shells to reach the target without exploding during flight.

We wish it to be understood that we do not desire to be limited to the exact method and detail of construction described, for obvious modifications will occur to persons skilled in the art.

We claim:

1. An impact sensitive fuze for explosive missiles comprising:

a truncated conically shaped body having a longitudinal axis and an axial bore;

said body having a plurality of apertures in its base extending transversely of said axial bore and communicating with said bore;

means for detonating said missile mounted in said bore; and barrier means, mounted in said bore intermediate the front end of said bore and said detonating means, adapted to provide an effective cover for said detonating means, thereby preventing moving objects from striking said detonating means, while permitting objects, such as droplets of water, to pass through said barrier means in directions inclined to the longitudinal axis;

wherein said barrier means is in the form of a twisted plate having a twist angle of at least 180°.

* * * * *